US005894886A

United States Patent [19]

Chiba et al.

[11] Patent Number: 5,894,886

[45] Date of Patent: Apr. 20, 1999

[54] HEAT EXCHANGER WITH FLUID CONTROL MEANS FOR CONTROLLING A FLOW OF A HEAT EXCHANGE MEDIUM AND METHOD OF MANUFACTURING THE SAME

[76] Inventors: Tomohiro Chiba; Shigeru Okada, both of c/o Sanden Corporation, 20 Kotobuki-Cho, Isesaki, Gunma 372, Japan

[21] Appl. No.: 08/767,408

[22] Filed: Dec. 16, 1996

[30] Foreign Application Priority Data

Dec. 14, 1995 [JP] Japan ..... 7-325597

[51] Int. Cl.[6] ..... F28F 9/02

[52] U.S. Cl. ..... 165/174; 165/173; 165/DIG. 482

[58] Field of Search ..... 165/110, 174, 165/173, 176; 29/890.052

[56] References Cited

U.S. PATENT DOCUMENTS

| | | | |
|---|---|---|---|
| 230,815 | 10/1880 | Puffer . | |
| 4,141,409 | 2/1979 | Woodhull, Jr. et al. | 165/110 |
| 4,691,765 | 9/1987 | Wozniczka | 165/80.3 |
| 4,877,083 | 10/1989 | Saperstein . | |
| 4,936,381 | 6/1990 | Alley . | |
| 4,960,169 | 10/1990 | Granetzke . | |
| 5,042,578 | 8/1991 | Tanabe . | |
| 5,052,478 | 10/1991 | Nakajima et al. . | |
| 5,107,926 | 4/1992 | Calleson . | |
| 5,119,552 | 6/1992 | Sutou et al. | 28/890.052 |
| 5,123,483 | 6/1992 | Tokutake et al. . | |
| 5,125,454 | 6/1992 | Creamer et al. . | |
| 5,152,339 | 10/1992 | Calleson . | |
| 5,207,738 | 5/1993 | Dey . | |
| 5,209,292 | 5/1993 | Arneson et al. . | |
| 5,236,044 | 8/1993 | Nagasaka et al. | 165/176 |
| 5,297,624 | 3/1994 | Haussmann et al. | 165/173 |
| 5,348,083 | 9/1994 | Hosoya et al. . | |
| 5,402,571 | 4/1995 | Hosoya et al. . | |
| 5,535,819 | 7/1996 | Matsura | 165/149 |
| 5,579,834 | 12/1996 | Chiba | 165/173 |
| 5,743,329 | 4/1998 | Damsohn et al. | 165/174 |

FOREIGN PATENT DOCUMENTS

| | | |
|---|---|---|
| 0027094 | 4/1981 | European Pat. Off. . |
| 0450619 | 10/1991 | European Pat. Off. . |
| 2665757 | 2/1992 | France . |
| 4325421 | 2/1995 | Germany . |
| 2-45667 | 12/1990 | Japan . |
| 7-29416 | 7/1995 | Japan . |
| 2078361 | 6/1981 | United Kingdom . |

*Primary Examiner*—Allen Flanigan

[57] ABSTRACT

At least one flow control member (127*a*) is fitted in a fitting groove (133) formed in a tank (121). An insertion hole (204) is formed in at least a part of the fitting groove (133). The flow control member (127*a*) has a projection (205) to be inserted into the insertion hole (204). The projection (205) is smaller in size than the insertion hole (204). The flow control member (127*a*) is arranged at a predetermined position within the tank (121). The fitting groove (133) is defined by a pair of side wall portions (203*b*) formed by internally cutting a tank wall of the tank (121) in a thickness direction along a pair of parallel cutting lines, and a guide portion (203*a*) formed by extruding a portion of the tank wall between the side wall portions (203*b*). The insertion hole (204) penetrates the guide portion (203*a*). The projection (205) has first and second tapered portions (351, 352, 354, 355) so that the thickness and the width are reduced towards the top end.

7 Claims, 16 Drawing Sheets

HEAT EXCHANGER WITH FLUID CONTROL MEANS FOR CONTROLLING A FLOW OF A HEAT EXCHANGE MEDIUM AND METHOD OF MANUFACTURING THE SAME

BACKGROUND OF THE INVENTION

This invention relates to a heat exchanger used in an oil cooler or a heater core mounted on an automobile, or for an evaporator or a condenser in an air conditioner, for example, an automotive air conditioner, and, in particular, to a heat exchanger with fluid control means for controlling a flow of a heat transfer medium. This invention also relates to a method of manufacturing the heat exchanger of the type.

Generally speaking, an internal fluid flowing through a pipe is heat-exchanged with an external fluid outside the pipe. The internal fluid is called a heat transfer medium which transports heat or cold between two areas. On the other hand, the external fluid is a fluid such as air, liquid and other fluid to be heated or cooled. In an air heating system, the heat transfer medium is a heat carrier such as a steam or a warm water which transports heat, while the external fluid is air. In an air cooling system, the heat transfer medium is called a refrigerant for cooling the air by the heat exchange therebetween. The air to be heated or cooled will often be referred to as a heat exchange air.

A first conventional heat exchanger comprises a pair of tanks, a plurality of tubes connecting those tanks each other, and a plurality of fins arranged and attached onto the tubes. Each of fins has an outer surface exposed to the external fluid to be heat-exchanged, for example, air in the air heating and/or cooling system.

The heat transfer medium is flown through the tubes from one of the tanks to the other. The heat or cold transported by the heat transfer medium is given to the air through the tube and fins. Therefore, the tubes and the fins are often referred to as heat exchange tubes and heat exchange fins, respectively. The heat exchange fins are for increasing the area of a heat exchanging surface with which the air comes into contact so as to receive the heat or cold.

The tubes and the fins are alternately arranged and assembled to form an integral structure. Each of the tanks is composed of a combination of a tank base member and a tank cover member. Each tank base member is connected to open ends of the tubes.

The tanks are provided with the fluid control means which comprises a single partition member and a plurality of flow regulation members.

The single partition member has a flat plate shape and is arranged in first one of the tanks at an approximate center in the longitudinal direction and separates the inside of the first tank into two chambers independent from each other.

The flow regulation members are arranged in the first tank and the other, or second, tank. In the first tank, the two independent chambers are separated into a plurality of sections in a longitudinal direction by provision of the flow regulation members. The inside of the second tank is also separated into a plurality of sections by the flow regulation members. Each of the flow regulation members has a hole formed in the center to communicate between sections at both sides of the flow regulation member. This hole serves to regulate the flow of the medium therethrough from one side to the other side of the flow regulation member, so that a liquid phase and a gas phase of the heat transfer medium are well mixed to provide a uniform flow of the medium.

The flow regulation members are arranged at a predetermined space from one another. The single partition member and the flow regulation members are, at their peripheral portions, fixed to inner walls of the tanks by brazing.

One of the chambers in the first tank, which will be referred to as an inlet chamber, is connected to an inlet pipe for introducing the medium thereinto and the other chamber, which will be referred to as an outlet chamber, is connected to an outlet pipe for discharging the medium therefrom.

In the heat exchanger described above, the medium flows into the inlet chamber of the first tank through the inlet pipe. Then, the medium flows from the first tank into the second tank through the tubes, thereafter returns from the second tank to the outlet chamber of the first tank through the tubes, and finally flows out from. the outlet chamber through the outlet pipe. In the meanwhile, the air flows through gaps between adjacent fins. Heat exchange is performed between the air and the medium flowing through the tubes.

In first conventional heat exchanger, the internal wall surface of each tank is cut to form a plurality of fitting grooves for fitting the single partition member and for the flow regulation members at predetermined positions. After the partition member and the flow regulation members are fitted into the fitting grooves, they are brazed to the internal wall surfaces of the tanks.

However, the above-mentioned first conventional heat exchanger is disadvantageous in that the fitting grooves are formed by the cutting process which requires great skill and is uneconomical.

In a second conventional heat exchanger, the cover member is formed with the fitting grooves by the deep drawing method. A single partition member and a plurality of flow regulation members are fitted in the fitting grooves in one-to-one correspondence and fixed by welding.

However, each fitting groove formed by the deep drawing process inevitably has a flared shape with rounded corners. In this event, the width of each fitting groove can not be made uniform in a depth direction. Specifically, the width is smallest and greatest at the bottom and the top of the groove.

The presence of the rounded corners results in a large clearance between the fitting groove and one of the single partition member and the flow regulation members that is fitted therein. Such a large clearance is difficult to be completely filled with a brazing member. This brings about vibration of such member in the fitting groove and deteriorates the reliability of brazing bond therebetween.

A third conventional heat exchanger is disclosed in Japanese Utility Model Publication (B4) No. H02-45667 (45667/1990). The heat exchanger comprises a pair of upper and lower tanks having a lower and upper opening portions, respectively, a pair of tube gathering plates arranged to cover the opening portions of the tanks, and a partition member dividing a tank cavity defined by one of the tanks and the corresponding one of the tube gathering plates.

A plurality of tubes are connected between the tube gathering plates. A plurality of fins are interposed between every adjacent ones of the tubes. On each tank, a reinforcing protuberance is formed to extend in a back-and-forth direction. An insertion hole is formed at the center of the protuberance to penetrate therethrough. The partition member has a projection formed at the center of an upper edge thereof to be fitted into the insertion hole.

The partition member is received within the internal space of the tank. The projection of the partition member is fitted into tide insertion hole. The upper edge of the partition member is brought into contact with the internal surface of the tank. The tank, the tube gathering plates, and the partition member are integrally bonded by brazing. At this time, the insertion hole is-sealed also.

A fourth conventional heat exchanger is disclosed in Japanese Utility Model Publication (B4) No. H07-29416 (29416/1995). The heat exchanger comprises a plurality of tubes for passing a heat transfer medium, a plurality of fins interposed between every adjacent ones of the tubes, a pair of tanks connected to the tubes and operable to introduce and discharge the medium, and a partition member dividing the internal space of each tank into a plurality of tank cavities independent from one another.

Each tank comprises a combination of a first tank plate and a second tank plate which can be separated in a radial direction. The first and the second tank plates are provided with positioning insertion holes and positioning fitting grooves to be engaged with the partition member.

The partition member is located between the first and the second tank plates to define the tank cavities. The partition member has a pair of engaging projections. The engaging projections are inserted into the insertion holes of the first and the second tank plates. Each tank and the partition member are integrally bonded by brazing. At this time, the insertion holes are sealed.

The projection of the partition member in each of the third and the fourth conventional heat exchangers is formed in a press-forming process of punching a single plate. As a result of punching, burrs are caused in a thickness direction of the plate. The presence of burrs makes it difficult to insert the projection into the insertion hole.

Specifically, as far as the projection has a configuration substantially same as that of the insertion hole to assure tight fit therebetween, the presence of the burrs prevents the insertion of the projection into the insertion hole.

Taking the above into consideration, the diameter of the insertion hole may be increased in order to smoothly insert the projection into the insertion hole. In this event, the clearance between the projection and the insertion hole is inevitably widened. Such a wide clearance can not completely be filled with a brazing member. This deteriorates reliability of the brazing.

Alternatively, the burrs must be removed before the projection is inserted into the insertion hole. This deteriorates the efficiency in assembling operation and increases the number of assembling steps.

SUMMARY OF THE INVENTION

It is therefore an object of this invention to provide a heat exchanger with a flow control member which can be smoothly and reliably assembled without occurrence of burrs and to provide a method of manufacturing the heat exchanger of the type described.

It is still another object of this invention to provide a heat exchanger which is improved in workability, efficiency in assembling operation, and reliability in brazing bond and to provide a method of manufacturing the heat exchanger of the type described.

According to this invention, there is provided a heat exchanger comprising a tube for passing a heat transfer medium therethrough, a tank connected to the tube, and at least one flow control member arranged within the tank to control the flow of the medium, wherein the tank has a fitting groove formed in at least a part thereof for fitting a peripheral edge of the flow control member, the fitting groove being defined by a pair of side wall portions and a guide portion between the side wall portions, the side wall portions being formed by internally cutting a tank wall of the tank in a thickness direction along parallel cutting lines to form parallel cut planes and by outwardly extruding a portion of the tank wall between the cut planes to form a protruding portion as the guide portion while the cut planes are exposed as the side wall portions, the guide portion having an insertion hole penetrating therethrough, the flow control member having a projection protruding from the peripheral edge to be inserted into the insertion hole.

According to this invention, there is provided a method of manufacturing a heat exchanger comprising a tube for passing a heat transfer medium therethrough, a tank connected to the tube, and at least one flow control member arranged within the tank to control the flow of the medium, the method comprising the steps of forming a fitting groove in the tank by internally cutting a tank wall of the tank in a thickness direction along parallel cutting lines to form parallel cut planes, outwardly extruding a portion of the tank wall between the cut planes to form a protruding portion as a guide portion while the cut planes are exposed as side wall portions, and forming an insertion hole penetrating through the guide portion, the fitting groove being defined by the side wall portions and the guide portion; forming the flow control member to be engaged with the fitting groove by punching a single plate material and simultaneously forming a projection protruding from a peripheral edge of the flow control member to be inserted into the insertion hole; fitting at least a part of the peripheral edge of the flow control member into the fitting groove with the projection inserted into the insertion hole; and bonding the flow control member and the tank by brazing.

DESCRIPTION OF THE PREFERRED EMBODIMENT:

In order to facilitate an understanding of this invention, several conventional heat exchangers will be described with reference to FIGS. 1 through 8.

Figure 1:
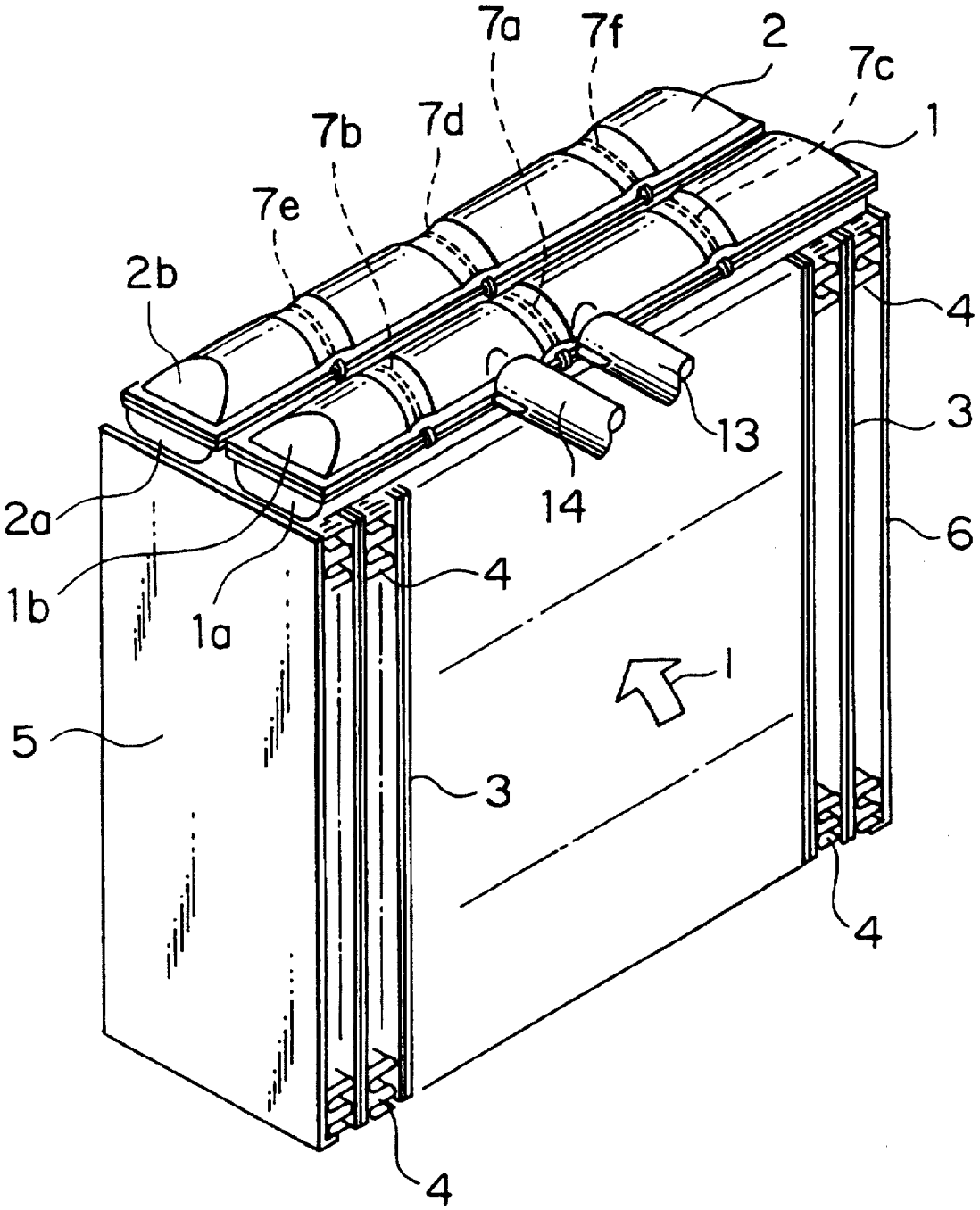
PRIOR ART FIG. 1
FIG. 1 is a perspective view of a first conventional heat exchanger.
Figure 2:
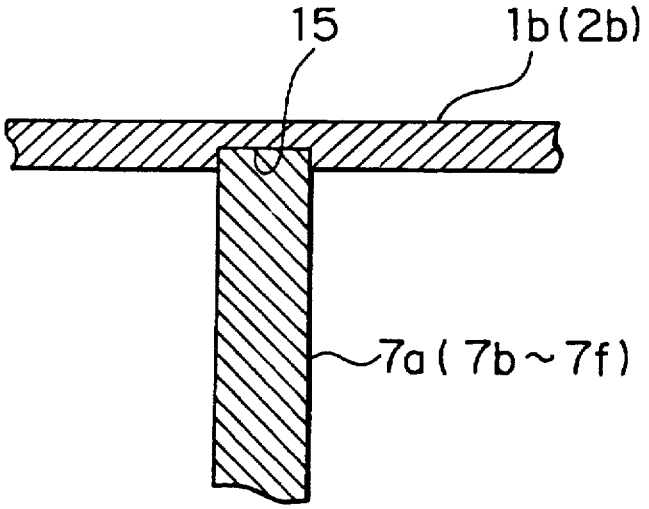
PRIOR ART FIG. 2
FIG. 2 is a sectional view of a part of a tank of. the heat exchanger illustrated in FIG. 1 with a partition member or a flow regulation member coupled thereto.

Referring to FIGS. 1 and 2, a first conventional heat exchanger for use as an evaporator comprises a pair of first and second tanks 1 and 2 for distributing and collecting a heat transfer medium, a plurality of heat exchange tube elements (hereinafter simply referred to as tubes) 3 connected to the first and the second tanks, and a plurality of fins 4 arranged adjacent to the tubes 3 and having outer surfaces exposed to heat exchange air.

The tubes 3 and the fins 4 are alternately arranged and assembled together to form an integral structure. A pair of side plates 5 and 6 are attached to both sides of the integral structure, namely, to a pair of outermost ones of the fins 4, respectively.

The first and the second tanks 1 and 2, the tubes 3, and the fins 4 are integrally bonded by brazing. Brazing is carried out within a heating apparatus such as an electric furnace at a predetermined temperature.

Each of the first and the second tanks 1 and 2 comprises a two-layer plate composed of a core member such as an aluminum plate and a brazing member as a coating member covering one surface of the core member.

In the heat exchanger, the first and the second tanks 1 and 2 are arranged in parallel to each other with their longitudinal direction perpendicularly intersecting an airflow depicted by an arrow I in the figure. In other words, the first and the second tanks 1 and 2 are arranged before and behind with respect to the airflow I.

Each of the first and the second tanks 1 and 2 is composed of a pair of pan-like members formed by pressforming a plate material.

Specifically, the first tank 1 comprises a first tank base member 1*a* of a pan-like shape and a first tank cover member 1*b* of a pan-like shape coupled thereto. The first tank base member 1*a* is connected to one open ends (not shown) of the tubes 3. The one open ends of the tubes 3 are located inside the first tank base member 1*a*.

Likewise, the second tank 2 comprises a second tank base member 2*a* and a second tank cover member 2*b* coupled thereto. The second tank base member 2*a* is connected to the other open ends (not shown) of the tubes 3. The other open ends of the tubes 3 are located inside the second tank base member 2*a*.

The first and the second tanks 1 and 2 have internal spaces through which a heat transfer medium flows. The first and the second tanks 1 and 2 are provided with a single partition member 7*a* and first through fifth flow regulation members 7*b* through 7*f*. The partition member 7*a* serves to inhibit the medium from flowing across the partition member 7*a*. The first through the fifth flow regulation members 7*b* through 7*f* serve to regulate the flow of the medium so that a liquid phase and a gas phase of the medium are well mixed to provide a uniform flow of the medium. Each of the first through the fifth flow regulation members 7*b* through 7*f* is formed by, for example, an aluminum plate.

The partition member 7*a* has a flat plate shape. On the other hand, each of the first through the fifth flow regulation members 7*b* through 7*f* has a shape substantially similar to that of the partition member 7*a* except that a hole (not shown) is formed at the center. This hole serves to regulate the flow of the medium in the above-mentioned manner.

The partition member 7*a* and the first through the fifth flow regulation members 7*b* through 7*f* are arranged within the first and the second tanks 1 and 2 to divide the internal spaces of the first and the second tanks 1 and 2 into a plurality of sections.

Specifically, the partition member 7*a* is arranged in the first tank 1 at its approximate center in the longitudinal direction. The first and the second flow regulation members 7*b* and 7*c* are arranged in the first tank 1 on the left and the right sides of the partition member 7*a* at a predetermined space therefrom, respectively.

On the other hand, the third flow regulation member 7*d* is arranged in the second tank 2 at its approximate center in the longitudinal direction. The fourth and the fifth flow regulation members 7*e* and 7*f* are arranged in the second tank 2 on the left and the right sides of the third flow regulation member 7*b* at a predetermined space therefrom, respectively.

The partition member 7*a* and the first and the second flow regulation members 7*b* and 7*c* are bonded to the first tank cover member 1*b* by-a brazing member. Likewise, the third through the fifth flow regulation members 7*d* through 7*f* are bonded to the second tank cover member 2*b* by the brazing member.

The first tank 1 is connected to an inlet pipe 13 for introducing the medium thereinto and an outlet pipe 14 for discharging the medium therefrom. Specifically, the inlet pipe 13 and the outlet pipe 14 are connected to the first tank 1 at positions slightly offset rightward and leftward from the longitudinal center of the first tank 1, respectively. The internal space of the first tank 1 is separated by the partition member 7*a* at the center between the inlet and the outlet pipes 13 and 14 to inhibit the flow of the medium across the partition member 7*a*.

In the heat exchanger described above, the circulation of the medium is as follows. Specifically, the medium decompressed by an external expansion valve is introduced through the inlet pipe 13 into the first tank 1 and flows through the tubes 3, the second tank 2, the tubes 3, and back to the first tank 1 to be discharged from the outlet pipe 14. The medium flows from the outlet pipe 14 to an external compressor. Then, the medium is introduced again to the inlet pipe 13, for example, through a condenser. In the meanwhile, heat exchange air flows outside of the fins 4 as depicted by the arrow I. Heat exchange is performed between the air and the medium flowing through the tubes 3.

The medium is introduced through the inlet pipe 13 into one approximate half of the first tank 1 in the longitudinal direction and then flows through the tubes 3 of a U shape. Subsequently, the medium is led into one approximate half of the second tank 2 and flows through the internal space of the second tank 2 to the other approximate half of the second tank 2. Then, the medium flows through the tubes 3 of a U shape to be led into the other approximate half of the first tank 1. Finally, the medium is discharged from the first tank 1 through the outlet pipe 14.

Referring to FIG. 2, description will be made about a fitting structure between the partition member 7*a* and the first tank 1. The fitting structure described below also applies to each of the first through the fifth flow regulation members 7*b* through 7*f* coupled to the first or the second tank 1 or 2.

A plurality of fitting grooves 15 are formed in the internal surfaces of the first and the second tank cover members 1*b* and 2*b* of the first and the second tanks 1 and 2 although only one is shown in the figure. In the illustrated example, the fitting grooves 15 are formed through a cutting process.

The fitting grooves 15 serve to fit the partition member 7*a* and the first through the fifth flow regulation members 7*b* through 7*f* at predetermined positions in the first and the second tanks 1 and 2.

Figure 3:
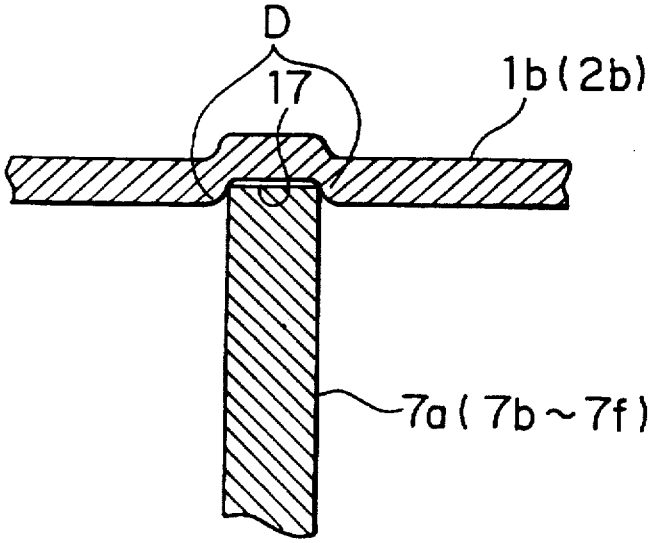
PRIOR ART FIG. 3
FIG. 3 is a sectional view of a part of a tank of a second conventional heat exchanger with a partition member or a flow regulation member coupled thereto.

Referring to FIG. 3, a second conventional heat exchanger adopts another fitting structure. Specifically, first and second tank cover members 1*b* and 2*b* are provided with a plurality of fitting grooves 17 formed by an deep drawing process. Peripheral edges of a partition member 7*a* and first through fifth flow regulation members 7*b* through 7*f* are partially fitted into the fitting grooves 17 and then fixed by brazing.

However, the fitting groove 15 illustrated in FIG. 2 is formed by the cutting process which requires great skill and is uneconomical.

On the other hand, the fitting groove 17 in FIG. 3 is formed by the deep drawing process and inevitably has rounded corners depicted at D in the figure. In this event, it is difficult to form the fitting groove 17 having a uniform width in the depth direction, as described in the preamble of the specification.

In addition, the presence of the rounded corners D results in a large clearance between the fitting groove 17 and any one of the partition member 7*a* and the first through the fifth flow regulation members 7*b* through 7*f* that is fitted therein. This brings about wobbling of such member in the fitting groove 17 and deteriorates the reliability of brazing bond therebetween.

Figure 4:
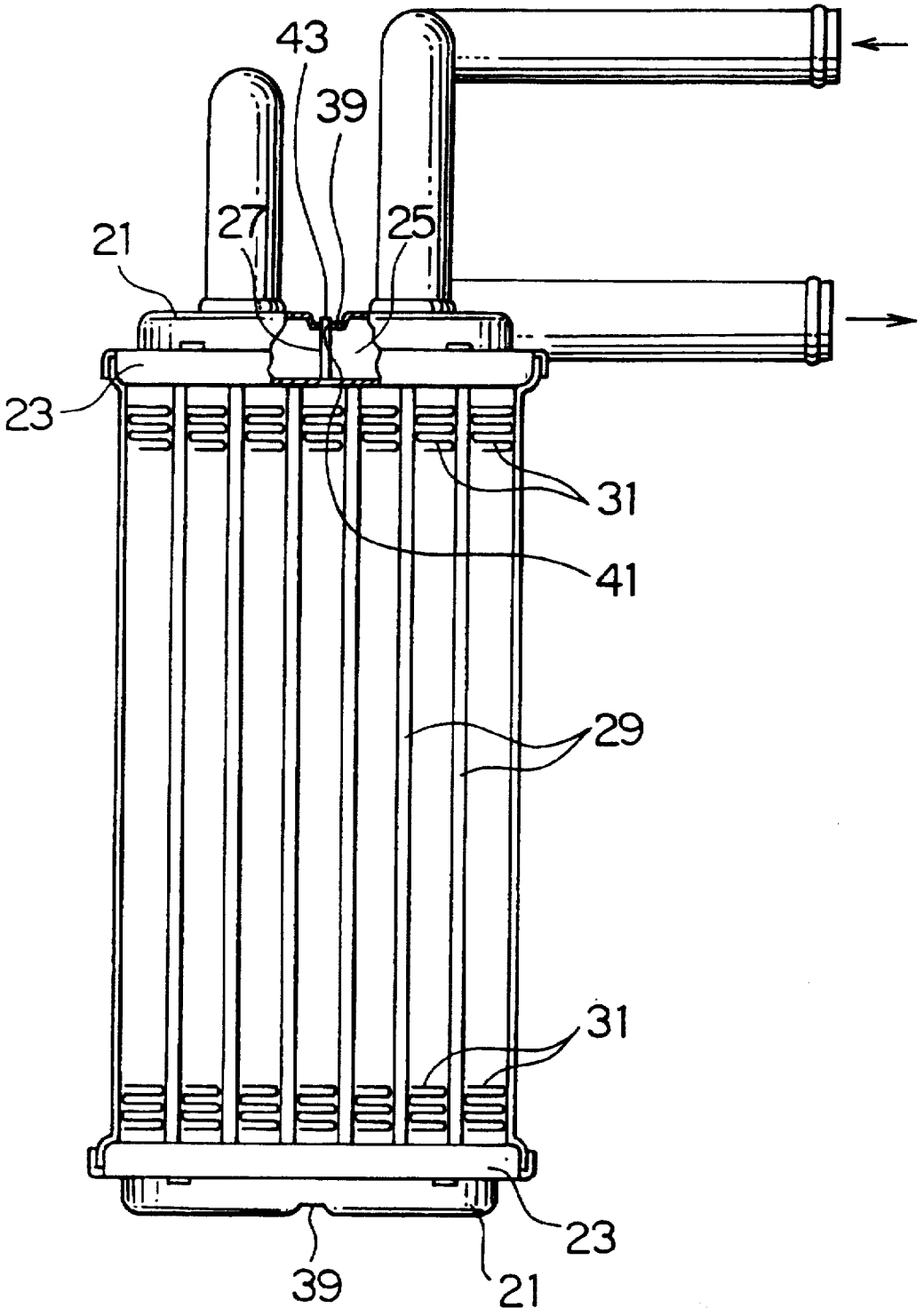
PRIOR ART FIG. 4
FIG. 4 is a front view of a third conventional heat exchanger.
Figure 5:
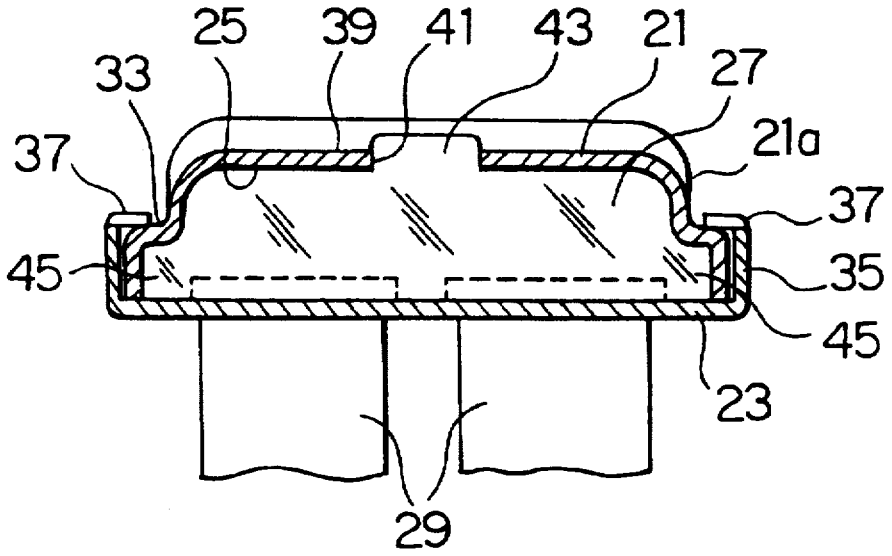
PRIOR ART FIG. 5
FIG. 5 is a partially-sectional side view of an upper part of one tank illustrated in FIG. 4.

Referring to FIGS. 4 and 5, a third conventional heat exchanger disclosed in Japanese Utility Model Publication (B4) No. H02-45667 (45667/1990) comprises a pair of tanks 21 of a box shape with one open surfaces, a pair of tube gathering plates 23 arranged at upper and lower parts to cover the open surfaces of the tanks 21, respectively, and a partition member 27 dividing one of tank cavities 25 defined by the tanks 21 and the tube gathering plates 23.

A plurality of tubes 29 are connected between the tube gathering plates 23. A plurality of fins 31 are interposed between every adjacent ones of the tubes 29. Each of the tanks 21 is provided with an annular step portion 33 formed on a side wall 21*a* at a peripheral edge of the open surface of the tank 21. Each of the tube gathering plates 23 has a protruding edge 35 protruding towards the tank 21. A desired number of flexible provisional latches 37 are formed on the protruding edge 35 on the front and the rear sides. A reinforcing rib 39 is formed on each tank 21 to extend in a back-and-forth direction.

An insertion hole 41 penetrates the center of the bottom wall of the rib 39. The partition member 27 has a projection 43 protruding from the center of the upper edge of the partition member 27 to be fitted in the insertion hole 41. The partition member 27 has a pair of extending portions 45 formed at front and rear ends to internally receive the step portions 33.

The partition member 27 is received within the tank 21 with the projection 43 inserted into the insertion hole 41. The remaining part of the upper edge of the partition member 27 except the projection 43 is brought into contact with the internal surface of the tank 21 while the upper edges of the extending portions 45 are brought into contact with the internal surfaces of the step portions 33.

When the tank 21 and the partition member 27 are coupled to the tube gathering plate 23, the latches 37 of the tube gathering plate 23 are bent. In this event, the top ends of the latches 37 are engaged with the step portions 33 of the tank 21 to thereby provisionally lock the tank 21 and the tube gathering plate 23.

In addition, the top end of the projection 43 of the partition member 27 is caulked to thereby lock the projection 43 to the tank 21. The tank 21, the tube gathering plate 23, and the partition member 27 are integrally coupled by brazing. Simultaneously, the insertion hole 41 is sealed.

Figure 6:
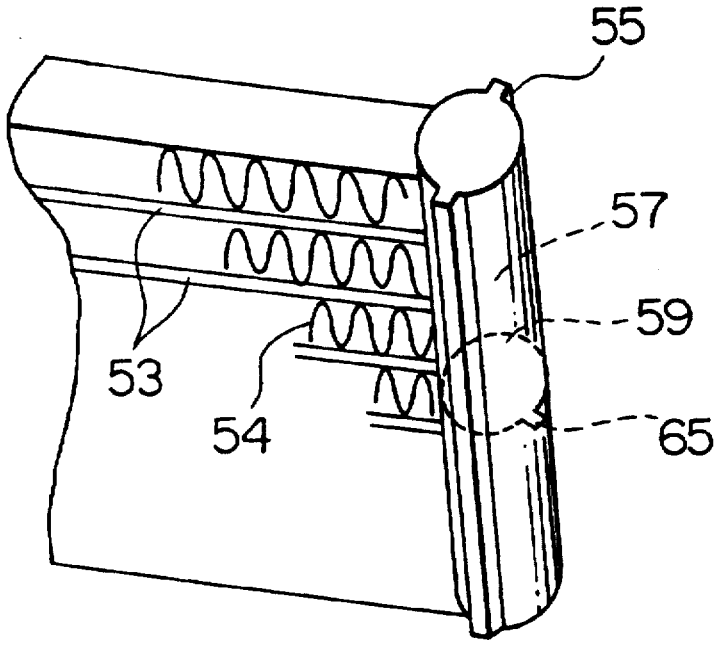
PRIOR ART FIG. 6
FIG. 6 is a perspective view of a main portion of a fourth conventional heat exchanger.
Figure 7:
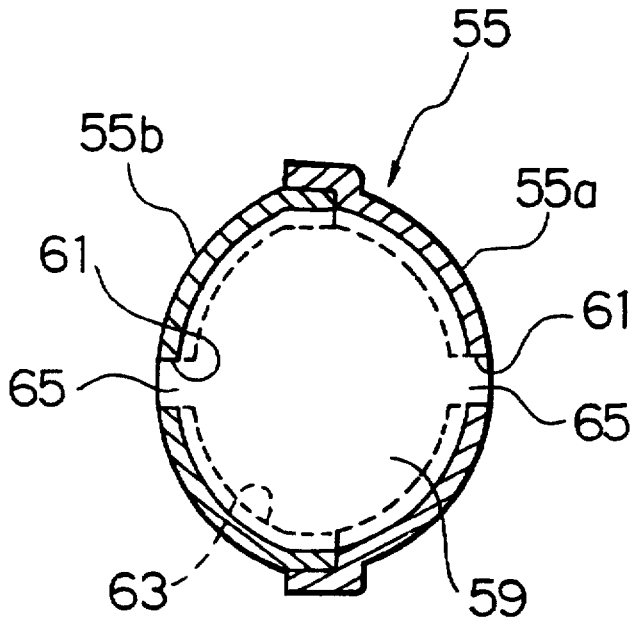
PRIOR ART FIG. 7
FIG. 7 is a transversal sectional view of one tank illustrated in FIG. 6 with a partition member coupled thereto.
Figure 8:
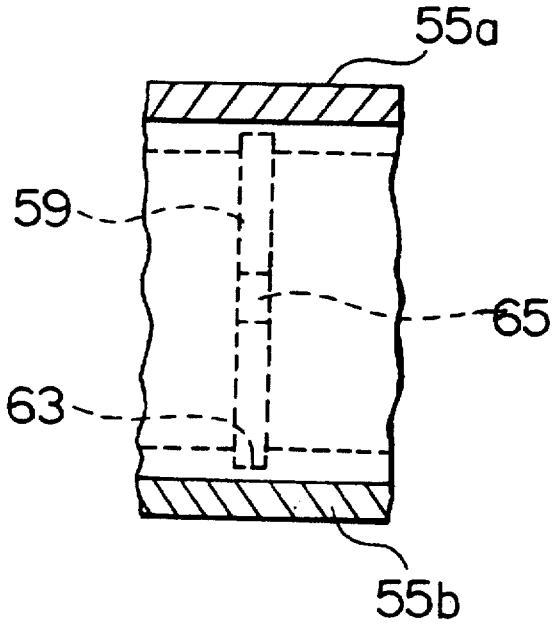
PRIOR ART FIG. 8
FIG. 8 is a longitudinal sectional view of the one tank illustrated in FIG. 6 with a partition member coupled thereto.

Referring to FIGS. 6 through 8, a fourth conventional heat exchanger disclosed in Japanese Utility Model Publication (B4) No. H07-29416 (29416/1995) comprises a plurality of tubes 53 for passing a heat transfer medium, a plurality of fins 54 interposed between every adjacent ones of the tubes 53, a pair of tanks 55 (only one being shown in FIG. 6) connected to the tubes 53 and operable to introduce and discharge the medium, and a partition member 59 dividing the internal space of each tank 55 into a plurality of tank cavities independent from one another.

Each tank 55 comprises a first tank plate 55*a* and a second tank plate 55*b* which can be separated in a radial direction. The first and the second tank plates 55*a* and 55*b* are provided with positioning insertion holes 61 and positioning engaging grooves 63 to be engaged with the partition member 59.

The partition member 59 is located between the first and the second tank plates 55*a* and 55*b* to define tank cavities 57. The partition member 59 has a pair of engaging projections 65. The positioning insertion holes 61 of the first and the second tank plates 55*a* and 55*b* are formed at positions corresponding to the engaging projections 65. The tanks 55 and the partition member 59 are bonded by brazing. At this time, the insertion holes 61 are sealed.

The projections 43 and 65 in the third and the fourth conventional heat exchangers are substantially similar in dimension and configuration to the insertion holes 41 and 61, respectively. As described in the preamble of the specification, the presence of burrs makes it difficult to insert the projections 43 and 65 into the insertion holes 41 and 61.

In view of the above, the burrs of the projections 43 and 65 must be completely removed before the projections 43 and 65 are inserted into the insertion holes 41 and 61. This deteriorates the workability and increases the number of assembling steps.

In order to smoothly insert the projections 43 and 65 into the insertion holes 41 and 61 even in presence of the burrs, it is proposed to increase the diameter of the insertion holes 41 and 61.

In this event, a large clearance is formed between the insertion holes 41 and 61 and the projections 43 and 65. When the insertion holes 41 and 61 and the projections 43 and 65 are bonded to each other by a brazing member, the brazing member can not completely be spread to leave an unbrazed part. This deteriorates the reliability of bond.

Now, description will proceed to a heat exchanger according to one embodiment of this invention with reference to FIGS. 9 through 21. The heat exchanger in this embodiment is for use as an evaporator mounted on an automobile to perform air conditioning.

At first referring to FIG. 9, the heat exchanger comprises a pair of first and second tanks 121 and 122 for distributing and collecting a heat transfer medium, a plurality of tube elements (hereinafter simply be referred to as tubes) 123 connected to the first and the second tanks 121 and 122, and a plurality of fins 124 arranged adjacent to the tubes 123 and having outer surfaces exposed air to be heat exchanged.

The tubes 123 and the fins 124 are alternately arranged and assembled together to form an integral structure. A pair of side plates 125 and 126 are attached to both sides of the integral structure, namely, to a pair of outermost ones of the fins 124, respectively.

Figure 10:
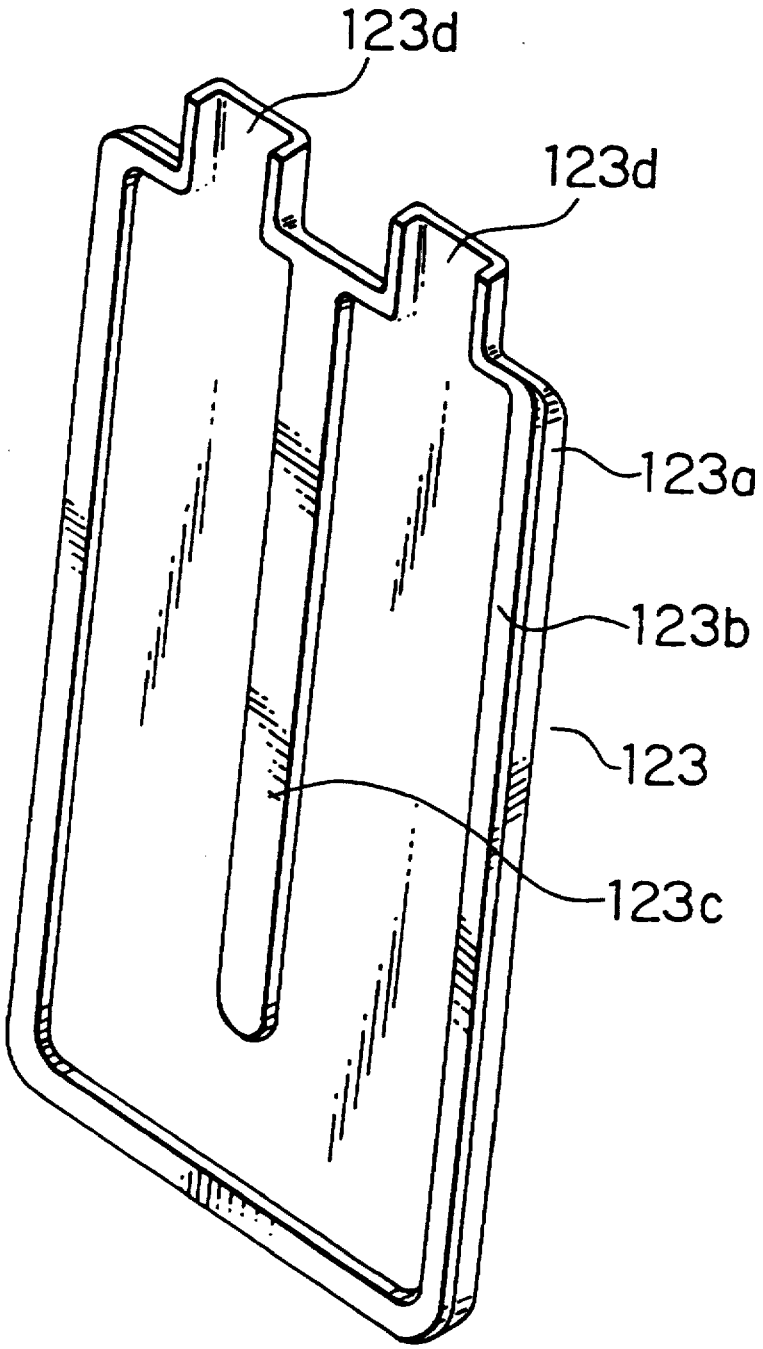
FIG. 10 is a perspective view of a part of a tube used in the heat exchanger illustrated in FIG. 9.

As illustrated in FIG. 10, each tube 123 is composed of a pair of tray-like members 123*a*. Each tray-like member 123*a* has a peripheral portion 123*b* formed at an entire periphery except top portions and a protruding wall 123*c* downwardly extending from the center between the top portions. The tray-like members 123*a* are coupled together with the peripheral portions 123*b* faced to each other and the protruding walls 123*c* faced to each other.

Each tube 123 thus formed has a pair of openings 123*d*. One of the openings 123*d* is connected to the first tank 121 while the other is connected to the second tank 122.

The first and the second tanks 121 and 122, the tubes 123, and the fins 124 are provisionally assembled and then integrally bonded by brazing. Brazing is carrier out within a heating apparatus such as an electric furnace at a predetermined temperature.

Each of the first and the second tanks 121 and 122 and the tubes 123 comprises a two-layer plate composed of a core member such as an aluminum plate and a brazing member as a coating member covering one surface of the core member. For example, the core member is formed by a material specified by JIS (Japan Industrial Standard) A3003.

As a material of the first and the second tanks 121 and 122 and the tubes 123, use may also be made of a cladding plate comprising a core member coated with a coating member of a brazing material.

Figure 9:
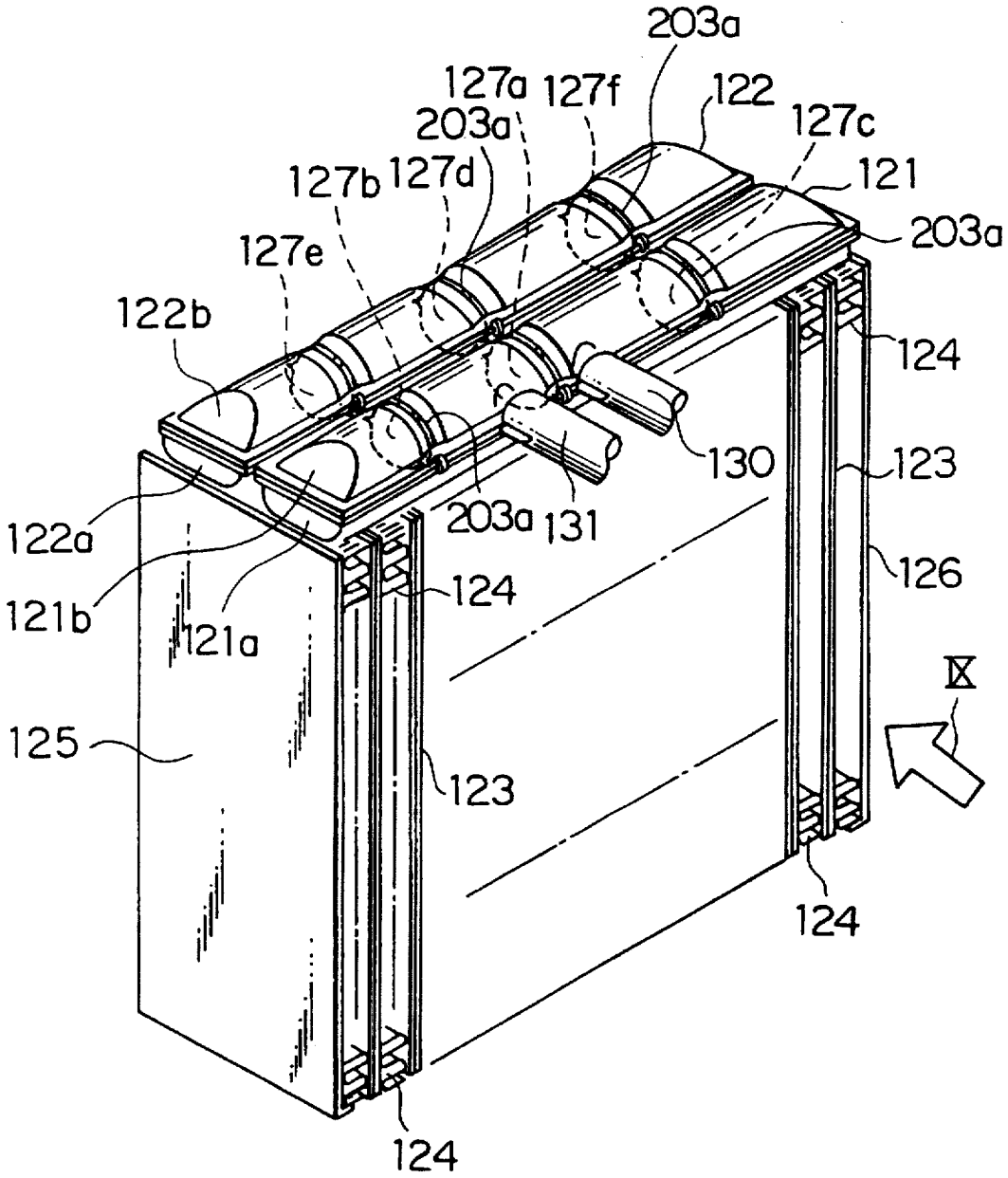
FIG. 9 is a perspective view of a heat exchanger according to one embodiment of this invention.

In the heat exchanger, the first and the second tanks 121 and 122 are arranged in parallel to each other with their longitudinal direction perpendicularly intersecting an airflow depicted by an arrow IX in FIG. 9. Specifically, the first and the second tanks 121 and 122 are arranged before and behind with respect to the airflow, respectively.

Figure 11:
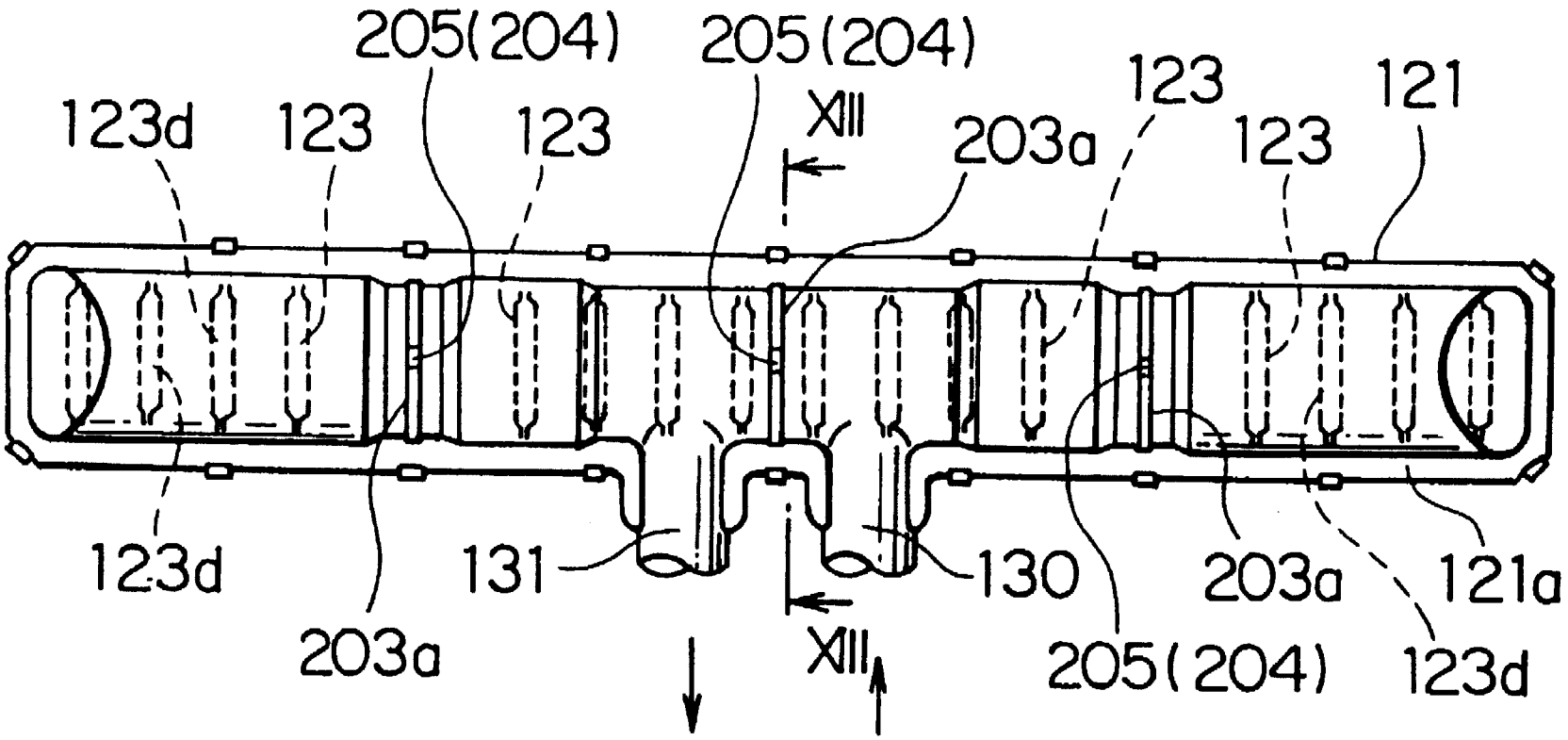
FIG. 11 is a top plan view of a first tank of the heat exchanger illustrated in FIG. 9.

Referring to FIG. 11 in addition, each of the first and the second tanks 121 and 122 is composed of combination of a pair of pan-like members formed by press-forming a plate material.

Specifically, the first tank 121 comprises a first tank base member 121*a* of a pan-like shape and a first tank cover member 121*b* of a pan-like shape coupled thereto. The first tank base member 121*a* is connected to one of the openings 123*d* of each tube 123. The one opening 123*d* is located inside the first tank base member 12la.

Likewise, the second tank 122 comprises a second tank base member 122*a* of a pan-like shape and a second tank cover member 122*b* of a pan-like shape coupled thereto. The second tank base member 122*a* is connected to the other of the openings 123*d* of each tube 123. The other opening 123*d* is located inside the second tank base member 122*a*.

The first and the second tanks 121 and 122 have internal spaces through whichoa heat transfer medium flows. The first and the second tanks 121 and 122 are provided with a single partition member 127*a* and first through fifth flow regulation members 127*b* through 127*f*. The partition member 127*a* serves to inhibit the medium from flowing across the partition member 127*a*, namely, to force the medium to flow in a single direction.

Each of the partition member 127*a* and the first through the fifth flow regulation members 127*b* through 127*f* comprises, for example, a cladding plate composed of an aluminum plate with its one surface coated with a brazing member.

The partition member 127*a* and the first through the fifth flow regulation members 127*b* through 127*f* are arranged within the first and the second tanks 121 and 122 to divide the internal spaces of the first and the second tanks 121 and 122 into a plurality of sections.

Specifically, the partition member 127*a* is arranged in the first tank 121 at its approximate center in the longitudinal direction. The first and the second flow regulation members 127*b* and 127*c* are arranged in the first tank 121 on the left and the right sides of the partition member 127*a* at a predetermined space therefrom, respectively.

On the other hand, the third flow regulation member 127*d* is arranged in the second tank 122 at its approximate center in the longitudinal direction. The fourth and the fifth flow regulation members 127*e* and 127*f* are arranged in the second tank 122 on the left and the right sides of the third flow regulation member 127*d* at a predetermined space therefrom, respectively.

The partition member 127*a* is coupled to the first tank 121 to completely separate the flow of the medium in the first tank frame 121. Each of the first through the fifth flow regulation members 127*b* through 127*f* is provided with a flow-through portion 241 (FIG. 18) which will later be described. The flow-through portion 241 serves to prevent the medium flowing through the first and the second tanks 121 and 122 in the longitudinal direction from being separated into a liquid phase and a gas phase, in other words, to regulate the flow of the medium so that the liquid phase and the gas phase are well mixed to provide a uniform flow of the medium.

The first tank 121 is connected to an inlet pipe 130 for introducing the medium thereinto and an outlet pipe 131 for discharging the medium therefrom. Specifically, the inlet and the outlet pipes 130 and 131 are connected to the first tank 121 at positions slightly offset rightward and leftward from the longitudinal center of the first tank 121, respectively. The internal space of the first tank 121 is separated by the partition member 127*a* at the center between the inlet and the outlet pipes 130 and 131 to inhibit the flow of the medium across the partition member 127*a*.

In the heat exchanger described above, the circulation of the medium is as follows. Specifically, the medium decompressed by an external expansion valve is introduced through the inlet pipe 130 into the first tank 121 and flows through the tubes 123, the second tank 122, the tubes 123, and back to the first tank 121 to be discharged from the outlet pipe 131.

The medium flows from the outlet pipe 131 to an external compressor. Then, the medium is introduced again to the inlet pipe 130 through any other component or components, for example, a condenser, of a medium flow circuit. In the meanwhile, air to be heat exchanged flows through gaps between adjacent fins 124 as depicted by an arrow IX in FIG. 9. Heat exchange is performed between the air and the medium flowing through the tubes 123.

Figure 12:
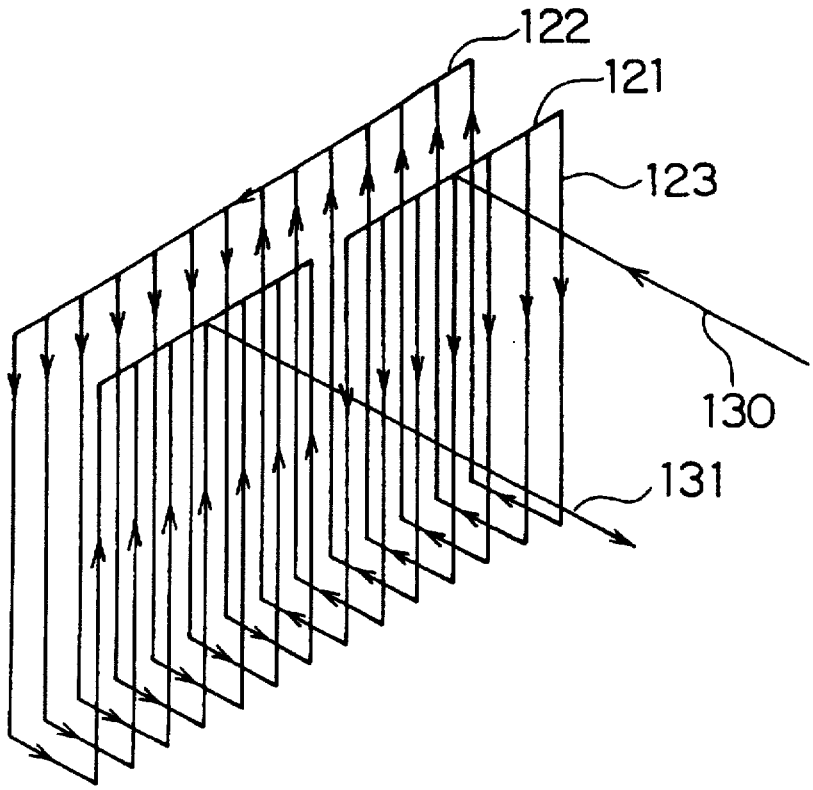
FIG. 12 is a view for describing the flow of a medium in the heat exchanger illustrated in FIG. 9.

Referring to FIG. 12, the medium flow circuit in the heat exchanger of the above-mentioned structure will be described. The medium flow circuit comprises four circuit portions. The flow of the medium is depicted by solid arrows.

The medium flow circuit illustrated in the figure includes the first and the second tanks 121 and 122, the tubes 123, the inlet and the outlet pipes 130 and 131 all of which are symbolically shown by solid lines.

As illustrated in FIG. 12, the medium introduced through the inlet pipe 130 is led into one approximate half of the first tank 121 (FIGS. 9 and 11) in the longitudinal direction because of presence of the partition member 127*a* separating the internal space of the first tank 121. The medium flows rightward through the second flow regulation member 127*c* arranged at the center of the one approximate half of the first tank 121 so that the liquid phase and the gas phase are well mixed to provide the uniform flow of the medium. Then, the medium passes through the tubes 123 of a U-shape (FIG. 10). Subsequently, the medium is led into one approximate half of the second tank 122 (FIGS. 9 and 11) in the longitudinal direction.

The second tank 122 has the third and the fifth flow regulation members 127*d* and 127*f* at positions corresponding to the partition member 127*a* and the second flow regulation member 127*c* in the first tank 121, respectively. During the travel through the second tank 122, the medium is uniformly mixed by the third and the fifth flow regulation members 127*d* and 127*f*.

The above-mentioned flow of the medium comprises two circuit portions, namely, the downward flow and the upward flow righthand in FIG. 12.

Thereafter, the medium is led through the fourth flow regulation member 127*e* located at the center of another approximate half of the second tank 122 and then passes through the tubes 123 of a U shape to be led into the another approximate half of the first tank 121. The medium passes through the first flow regulation member 127*b* located at the center of another approximate half of the first tank 121 to be discharged through the outlet pipe 131.

The above-mentioned flow of the medium comprises another two circuit portions, namely, the downward flow and the upward flow lefthand in FIG. 12.

Figure 13:
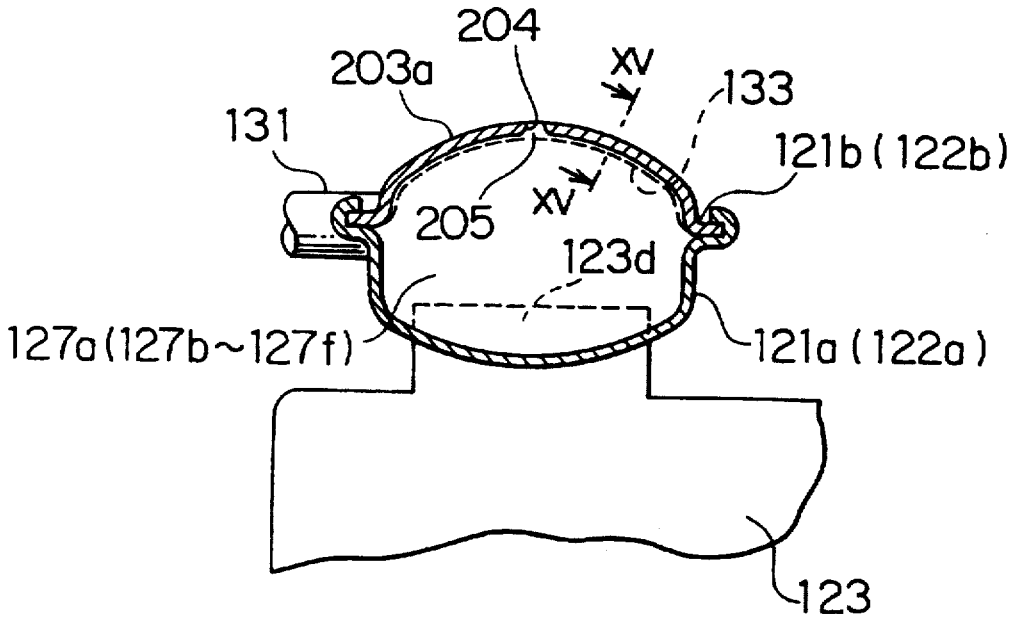
FIG. 13 is a sectional view taken along a line XIII—XIII in FIG. 11.
Figure 14:
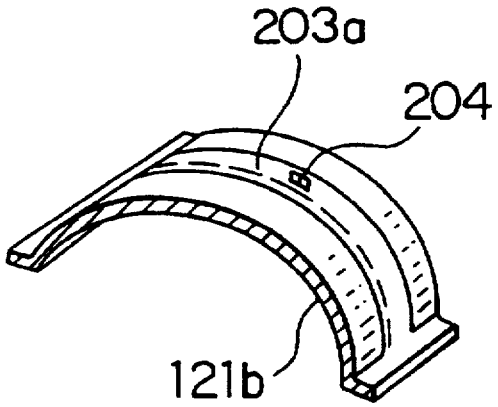
FIG. 14 is a perspective view of a main portion of the first tank illustrated in FIG. 9.
Figure 15:
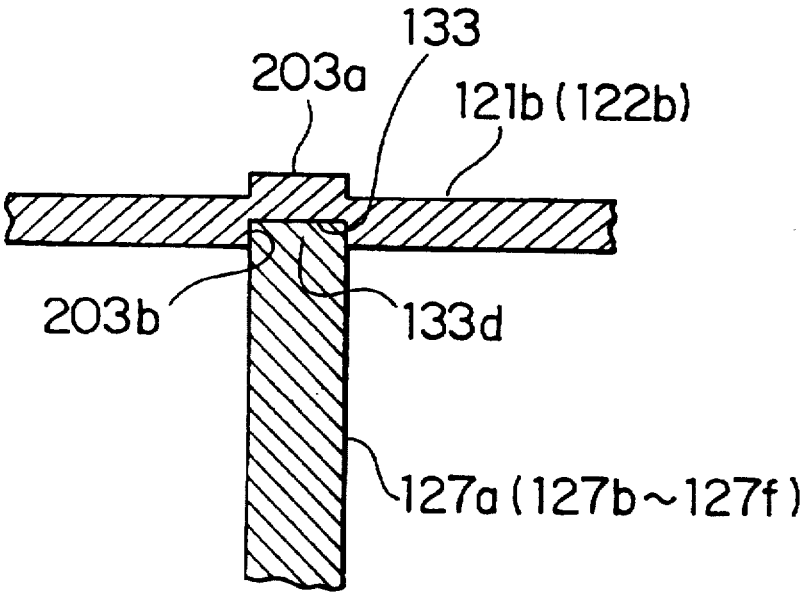
FIG. 15 is a sectional view taken along a line XV—XV in FIG. 13.

Referring to FIGS. 13 through 15, the partition member 127*a* will be described more in detail.

Referring to FIG. 13, the partition member 127*a* is fitted to the first tank 121. In the example being illustrated, a fitting groove 133 is formed in the internal surface of the first tank cover member 121*b*.

Specifically, as seen from FIGS. 13 and 15, the fitting groove 133 is formed at a predetermined position of the first tank 121 in the first tank cover member 121*b* so as to fit the partition member 127*a* therein.

Figure 16:
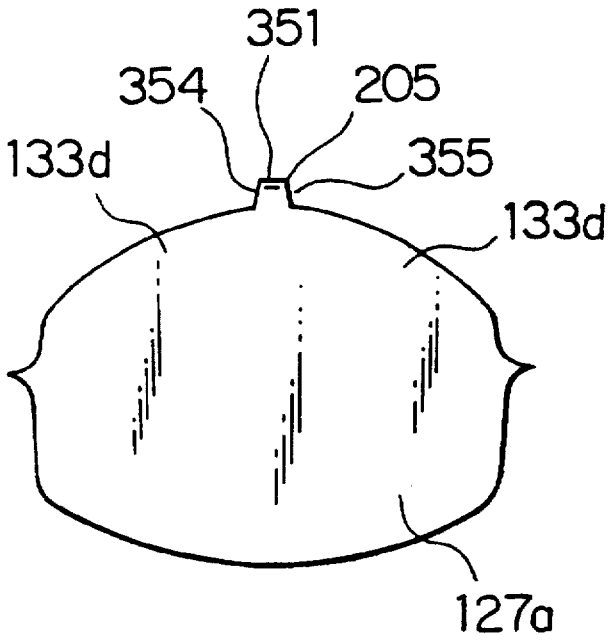
FIG. 16 is a front view of a partition member illustrated in FIG. 13.

The partition member 127*a* has a flat shape as illustrated in FIGS. 15 and 16.

The first and the second flow regulation members 127*b* and 127*c* are arranged in the first tank 121 left and right of th e partition member 127*a* at a predetermined space therefrom. The third flow regulation member 127*d* is located in the second tank 122 at an approximate center in the longitudinal direction. The fourth and the fifth flow regulation members 127*e* and 127*f* are arranged in the second tank 122 left and right of the third flow regulation member 127*d* at a predetermined space therefrom.

The first and the second tank cover members 121*b* and 122*b* are provided with a plurality of similar fitting grooves 133 to fit the first through the fifth flow regulation members 127*b* through 127*f*.

The partition member 127*a*, the first and the second flow regulation members 127*b* and 127*c*, and the first tank cover member 121*b* are bonded together by a brazing member. Likewise, the third through the fifth flow regulation members 127*d* through 127*f* and the second tank cover member 122*b* are bonded together by the brazing member.

Specifically, a part of the peripheral edge of the partition member 127*a* is fitted into a corresponding one of the fitting grooves 133 of the first tank cover member 121*b* before the first tank cover member 121*b* and the partition member 127*a* are bonded by brazing. The first through the fifth flow regulation members 127*b* through 127*f* are fitted to the first or the second tank cover members 121*b* and 122*b* in the similar manner.

Referring to FIG. 14 in addition, each fitting groove 133 is defined by a guide portion 203*a* and a pair of side wall portions 203*b* and extends along an arc of the first tank cover member 121*b*. The side wall portions 203*b* are formed by making parallel cut planes to an approximate half depth of the thickness of the first tank cover member 121*b*. The guide portion 203a is formed by outwardly protruding a portion of a tank wall between the side wall portions 203*b* in the form of a strap plate. The guide portion 203*a* is protruded to a height corresponding to an approximate half of the thickness of the first tank cover member 121*b*.

Specifically, the guide portion 203*a* in FIGS. 9 and 13 through 15 has a protruding portion slightly protruding on the outer surface of the first tank cover member 121*b*. The fitting groove 133 is defined by the internal surface of the guide portion 203*a* and the side wall portions 203*b*.

Each fitting groove 133 is formed in the first tank cover member 121*b* in the manner which will presently be described. At first, the first tank cover member 121*b* is cut on parallel planes perpendicular to the longitudinal direction of the first tank cover member 121*b* to a depth corresponding to the approximate half of the thickness of the first tank cover member 121*b*. The portion of the tank wall between the cut planes is extruded outwards to form the guide portion 203*a* slightly protruding from the outer surface of the first tank cover member 121*b* while the cut planes are exposed to form the side wall portions 203*b*. Thus, the fitting groove 133 is defined by the internal surface of the guide portion 203*a* and the side wall portions 203*b*.

The extruding process of the guide portion 203*a* can be easily carried out if the first tank cover member 121*b* is formed by an aluminum plate. In the manner similar to that mentioned above, the similar fitting grooves 133 are formed in the second tank cover member 122*b*.

The guide portion 203*a* has an insertion hole 204 formed at the center thereof. The insertion hole 204 is formed simultaneously when the guide portion 203*a* is formed. Into the insertion hole 204, a projection 205 of the partition member 127*a* is inserted. As will later be described in detail, the projection 205 has a size substantially equal to or slightly smaller than that of the insertion hole 204.

Referring to FIG. 16, the partition member 127*a* has an upper peripheral edge 133*d* of an arc shape corresponding to the configuration of the fitting groove 133. The peripheral edge 133*d* is fitted into the fitting groove 133 with the projection 205 inserted into the insertion hole 204.

Figure 17:
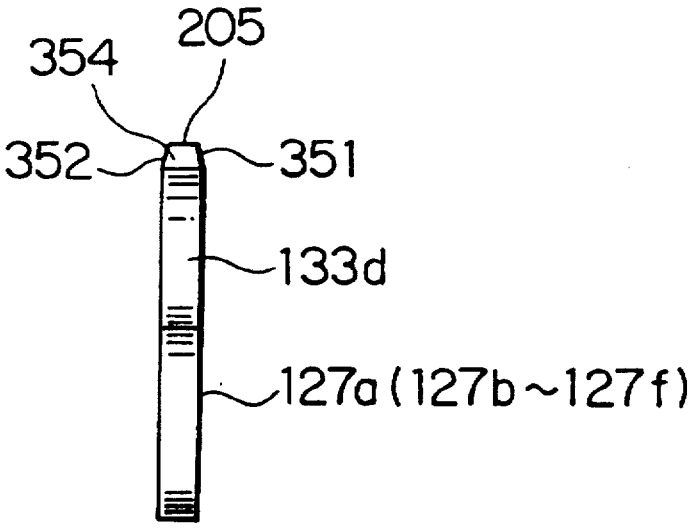
FIG. 17 is a side view of the partition member illustrated in FIG. 16.

Referring to FIG. 17 in addition, the projection 205 of the partition member 127*a* has a tapered shape. Specifically, the projection 205 has a pair of first tapered portions 351 and 352 and a pair of second tapered portions 354 and 355. As illustrated in FIG. 17, the first tapered portions 351 and 352 are formed so that the thickness of the projection 205 is reduced towards its top end. On the other hand, the second tapered portions 354 and 355 are formed so that the width of the projection 205 is reduced towards the top end as clearly seen from FIG. 16.

When the projection 205 is inserted into the insertion hole 204, the clearance between a base portion of the projection 205 and the insertion hole 204 is minimized while the top end of the projection 205 is smaller in thickness and width directions than the insertion hole 204.

Figure 18:
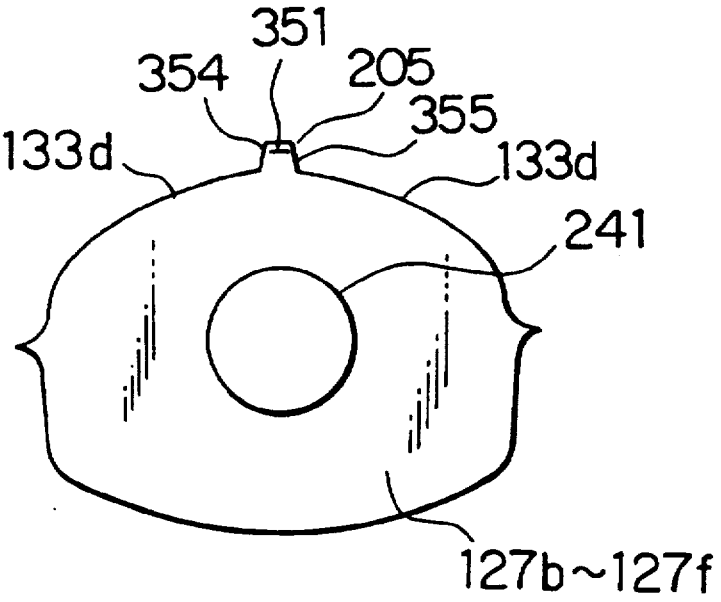
FIG. 18 is a front view of-a flow regulation member used in the heat exchanger illustrated in FIG. 9.

Referring to FIG. 18, each of the first through the fifth flow regulation members 127*b* through 127*f* has a configuration substantially similar to that of the partition member 127*a* except that the flow-through portion 241 is formed at the center. The flow-through portion 241 can be formed simultaneously when each of the first through the fifth flow regulation members 127*b* through 127*f* is formed. The first through the fifth flow regulation members 127*b* through 127*f* are fitted into the fitting grooves 133 formed in the first and the second tank cover members 121*b* and 122*b* in one-to-one correspondence.

Like the partition member 127*a*, each of the first through the fifth flow regulation members 127*b* through 127*f* has a similar projection 205 of the above-mentioned tapered shape. Each of the first through the fifth flow regulation members 127*b* through 127*f* is inserted into a corresponding one of the fitting grooves 133 with the projection 205 fitted into the insertion hole 204 in the manner similar to that described in conjunction with the partition member 127*a*.

The flow-through portion 241 may be a single hole or a plurality of holes formed at the center. Alternatively, the flow-through portion 241 may be a notch which allows passage of the medium in the longitudinal direction of the first or the second tank 121 or 122.

All of the partition member 127*a* and the first through the fifth flow regulation members 127*b* through 127*f* have a function of controlling the flow of the medium and will therefore may be referred to as flow control members.

Hereinafter, the projection 205 of each of the partition member 127*a* and the first through the fifth flow regulation members 127*f* will be described in detail for the shape and the size.

Figure 19:
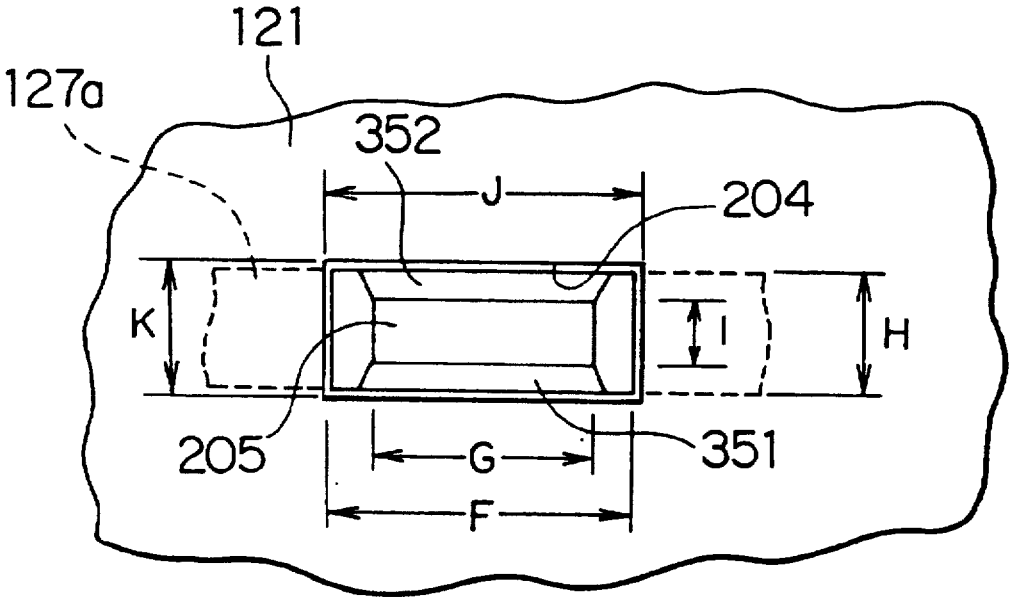
FIG. 19 is an enlarged plan view for describing a dimensional relationship between a projection of the partition member illustrated in FIG. 16 and an insertion hole of the first tank.

Referring to FIG. 19, the projection 205 of the partition member 127*a* is inserted into the insertion hole 204. The insertion hole 204 has a longitudinal size K and a transversal size J. The projection 205 has a base thickness H and a base width F at its base portion. The base thickness H of the projection 205 is substantially equal to or slightly smaller than the longitudinal size K of the insertion hole 204. Likewise, the base width F of the projection 205 is substantially equal to or slightly smaller than the transversal size J of the insertion hole 204.

Figure 20:
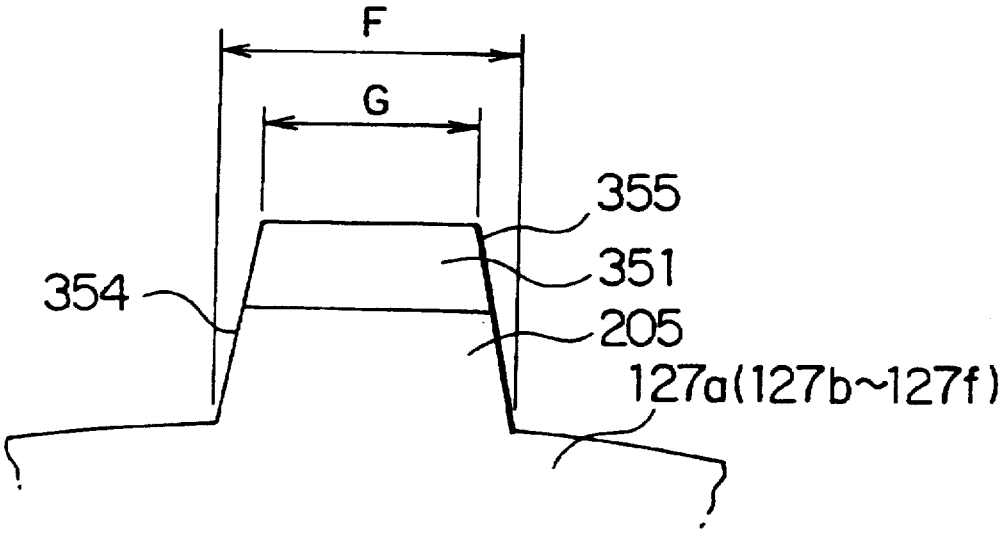
FIG. 20 is an enlarged front view of the projection illustrated in FIGS. 19 for describing the dimensional relationship.
Figure 21:
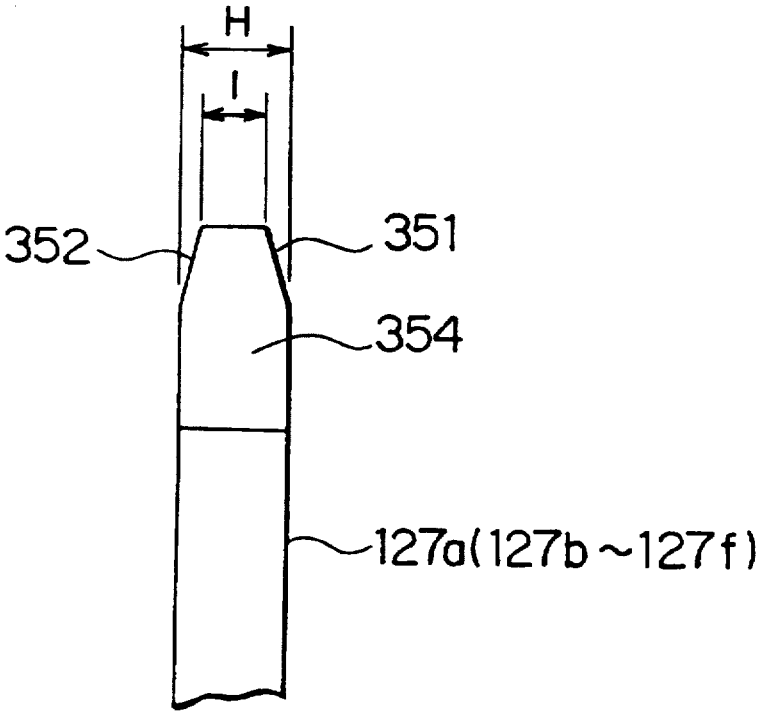
FIG. 21 is an enlarged side view of the projection illustrated in FIG. 20 for describing the dimensional relationship.

Referring to FIGS. 20 and 21, the projection 205 has a top thickness I and a top width G at its top end. The top thickness I and the top width G are smaller than the base thickness H and the base width F, respectively.

Specifically, the projection 205 is reduced in thickness towards the top end by the presence of the first tapered portions 351 and 352. In other words, the top thickness I is smaller than the base thickness H (I <H). Likewise, the projection 205 is reduced in width towards the top end by the presence of the second tapered portions 354 and 355. In other words, the top width G is smaller than the base width F (G <F). The base thickness H and the base width F of the projection 205 are substantially equal to or slightly smaller than the longitudinal size K and the transversal size J of the insertion hole 204, respectively.

Next referring to FIGS. 22 through 28, description will be made as regards a method of producing each of the first through the fifth flow regulation members 127*b* through 127*f*.

Each of the first through the fifth flow regulation members 127*b* through 127*f* is produced by successively machining a strap-like thin sheet material 400 of an aluminum alloy while it is conveyed on a transfer line. The sheet material 400 has a thickness equal to that of each of the partition member 127*a* and the first through the fifth flow regulation members 127*b* through 127*f*. The thickness corresponds to the base thickness H of the projection 205.

Since the first through the fifth flow regulation members 127*b* through 127*f* have a same configuration, description will be directed to the first flow regulation member 127*b* alone as a representative example.

Figure 22:
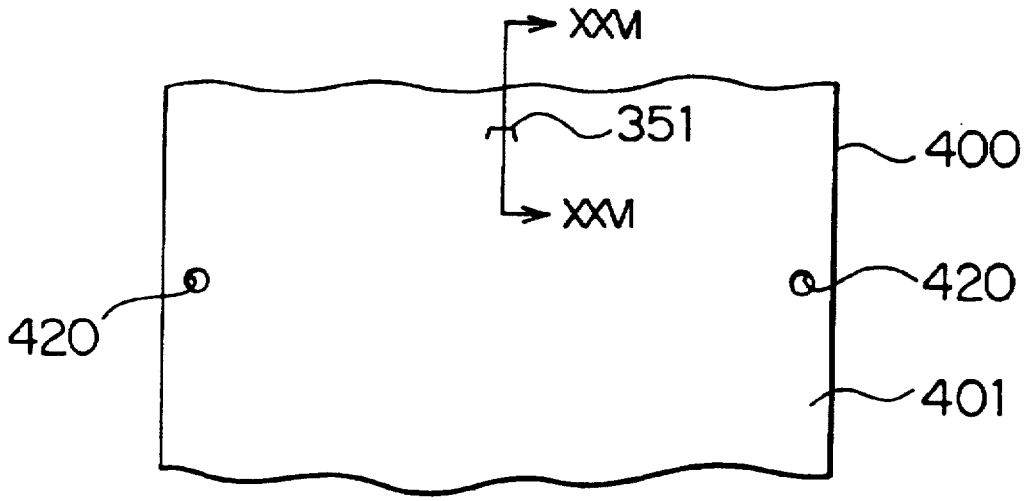
FIG. 22 is a view for describing a step of forming a first tapered portion in manufacturing a flow regulation member illustrated in FIG. 18.

Referring to FIG. 22, the sheet material 400 is machined while it is moved on a bed 500 (FIG. 26) in a single direction with its one surface 401 kept upside. The sheet material 400 is provided with a plurality of guide holes 420 formed in the vicinity of both transversal side edges thereof. The guide holes 420 serve to move the sheet material 400 when engaged with pins driven by a driving unit (not shown).

Figure 26:
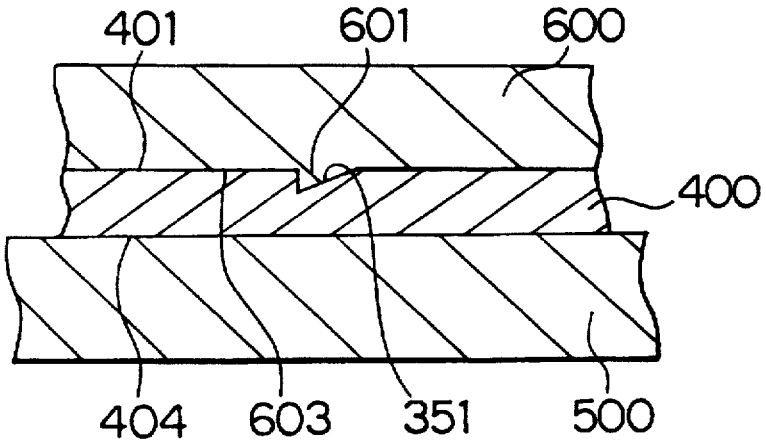
FIG. 26 is a sectional view taken along a line XXVI—XXVI in FIG. 22.

As illustrated in FIG. 26, a rear surface 404 of the sheet material 400 opposite to the one surface 401 lies on the bed 500. A press die 600 is located on a predetermined position faced to the one surface 401 of the sheet material 400. The press die 600 has a plurality of projections 601 at a predetermined space. One of the projections 601 corresponds to a position where one of the first tapered portions 351 is formed.

The one of the first tapered portions 351 of the projection 205 is formed by lowering the press die 600 towards the bed 500 with the one surface 401 of the sheet material 400 faced to a flat surface 603 of the press die 600. As a consequence, the one of the first tapered portions 351 of the projection 205 is formed by the projection 601 of the press die 600.

Figure 23:
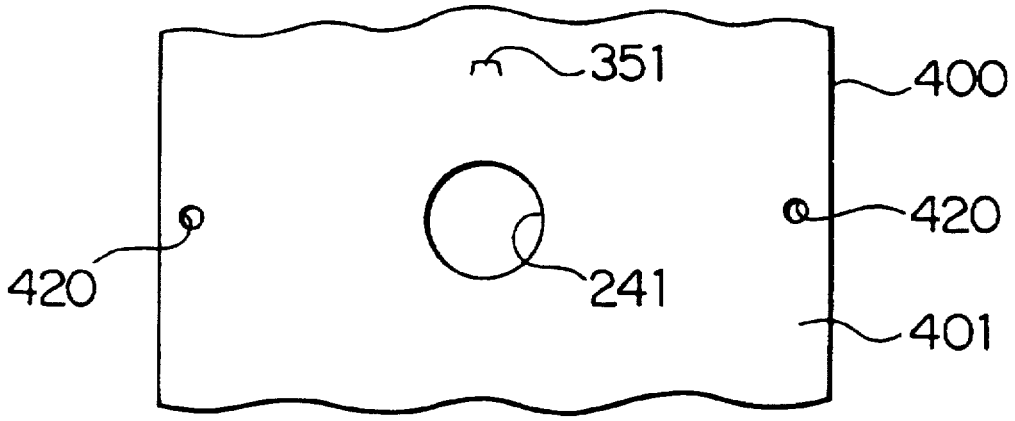
FIG. 23 is a view for describing a step of forming a hole following the step illustrated in FIG. 22.
Figure 24:
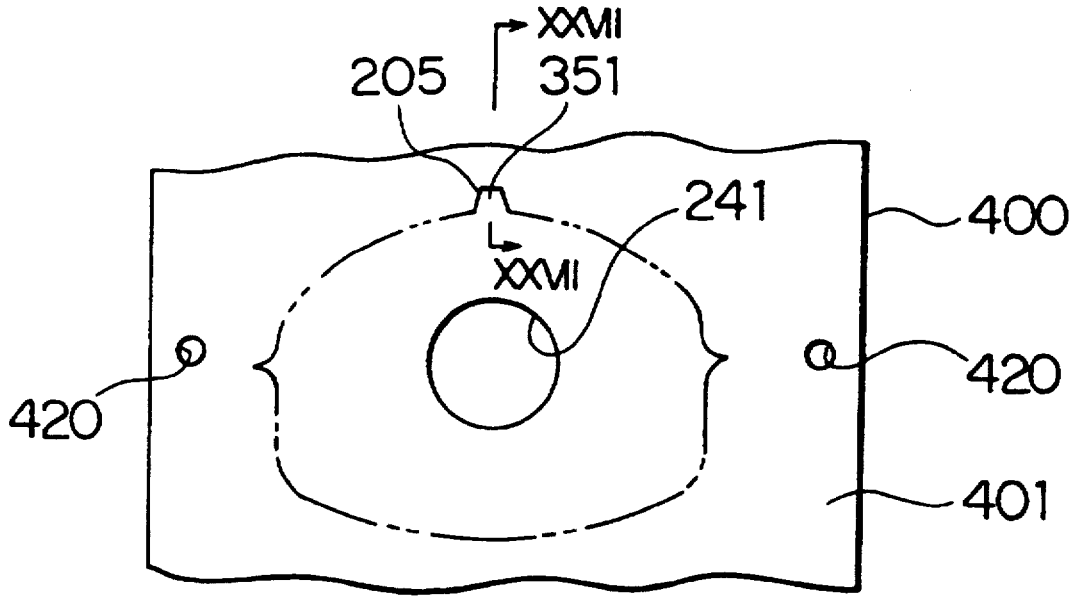
FIG. 24 is a view for describing a step of extruding the flow regulation member following the step illustrated in FIG. 23.
Figure 27:
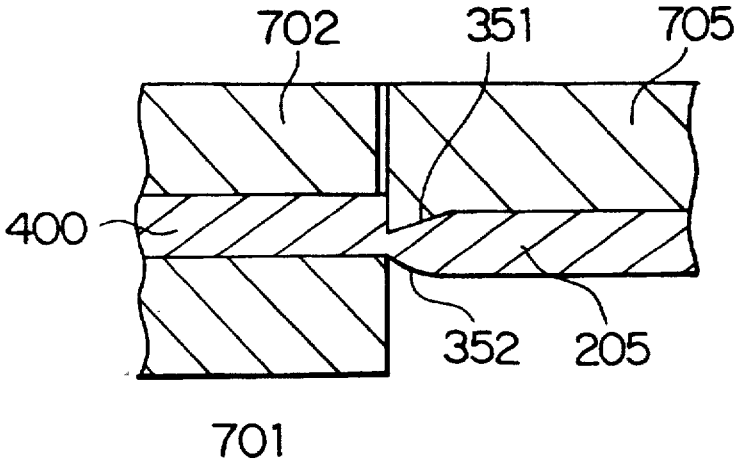
FIG. 27 is a sectional view taken along a line XXVII—XXVII in FIG. 24.

Then, the sheet material 400 is moved in the one direction from the state illustrated in FIG. 22. As illustrated in FIG. 23, the flow-through portion 241 is formed in the sheet material 400 by a boring blade (not shown). The sheet material 400 is further moved in the one direction from the state illustrated in FIG. 23. The sheet material 400 is then clamped by a pair of clamping dies 701 and 702. As illustrated in FIGS. 24 and 27, the sheet material 400 is extruded in the form of the first flow regulation member 127*b* by lowering a cutting die 705 onto the one surface 401. The sheet material 400 is cut by the cutting die 705 to a depth corresponding to about 50 to 80% of the thickness of the first flow regulation member 127*b*. At this time, the top end of the projection 205 is still connected to the remaining part of the sheet material 400. During this cutting process, another side of the projection 205 opposite to the one of the first tapered portions 351 is pulled up towards the cutting end face of the sheet material 400 to thereby form the other of the first tapered portions 352, as illustrated in FIG. 27.

Figure 25:
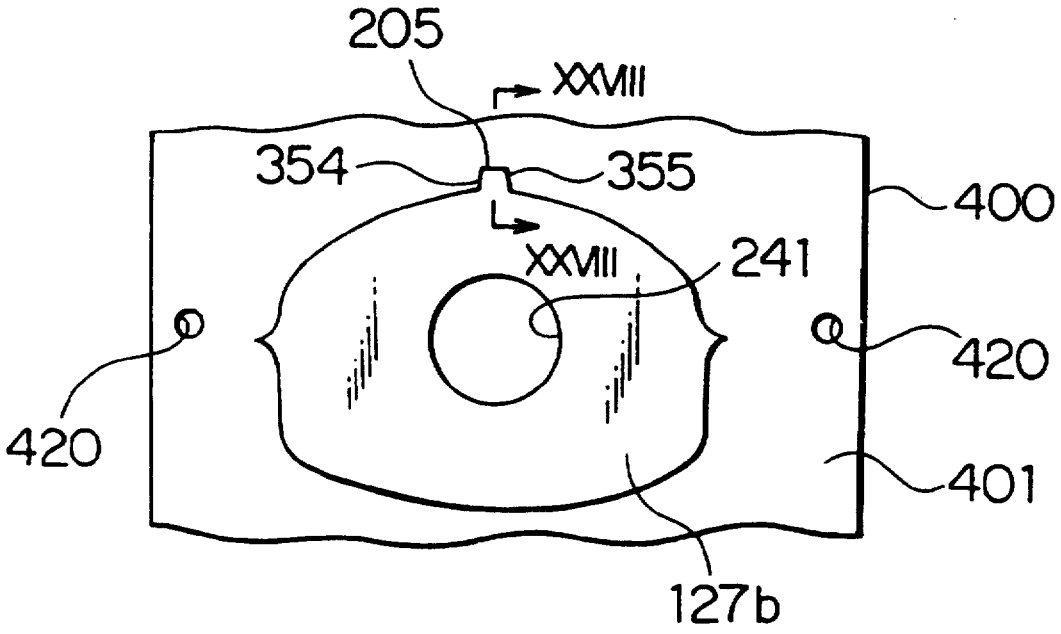
FIG. 25 is a view for describing a step of cutting the flow regulation member following the step illustrated in FIG. 24.
Figure 28:
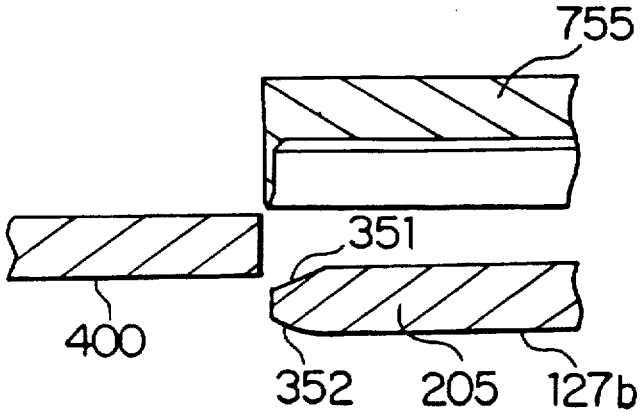
FIG. 28 is a sectional view taken along a line XXVIII—XXVIII in FIG. 25.

Finally, as illustrated in FIGS. 25 and 28, the top end of the projection 205 between the first tapered portions 351 and 352 is separated from the sheet material 400 by a flat blade 755. Thus, the first flow regulation member 127*b* is obtained. At the same time, the third and the fourth tapered portions 354 and 355 of the projection 205 are formed by the flat blade 755.

As described above, the process of producing the first through the fifth flow regulation members 127b through 127*f* adopts the two processes illustrated in FIGS. 27 and 28 by which the pull-up of the thickness of the other first tapered portion 352 is intentionally enhanced. As a result, the other of the first tapered portions 352 is more explicitly formed.

It is noted here that,.the partition member 127*a* is formed by in the manner similar to that described in conjunction with FIGS. 22 through 28 except that the process of forming the flow-through portion 241 in FIG. 23 is omitted.

In the above-mentioned process, the burrs which have been caused in cutting the projection 205 are prevented from occurrence by the step of forming the first tapered portions 351.

Accordingly, it is possible to uniformly insert the projection 205 into the insertion hole 204 because no burrs are formed.

According to this invention, the clearance between the projection 205 and the insertion hole 204 is minimized by the tapered structure. It is therefore possible to prevent wobbling of the projection 205 in the insertion hole 204 and to improve the assembling efficiency and the reliability brazing bond.

F u rthermore, the top end of the projection 205 is smaller than the insertion hole 204 because of presence of the first tapered portions 351 and 352 as well as the second tapered portions 354 and 355. Thus, projection 205 can easily be inserted into the insertion hole 204 to theereby improve the efficiency in assembling the partition member 127*a* and the first through the fifth flow regulation members 127*b* through 127*f* into the fitting grooves 133.

In the fore going embodiment, the partition member 127*a* of a flat shape is one in number while the first through the fifth flow regulation members 127*b* through 127*f* are provided with the flow-through portions 241.

However , depending upon the direction of the flow of the medium and the structure of the heat exchanger, the number and the arrangement of the partition member and the flow regulation members are variable case by case. Thus, this invention is not restricted to the structure and the arrangement in the foregoing embodiment.

Although the fitting grooves 133 are formed in first and the second tank cover members 121*b* and 122*b*, those grooves may be formed throughout the entire internal circumferences of the first and the second tanks 121 and 122.

What is claimed is:

1. A heat exchanger comprising:

a tube for passing a heat transfer medium therethrough;

a tank connected to said tube; and at least one flow control member arranged within said tank to control the flow of said medium, said flow control member having a projection protruding from a peripheral edge, said tank having a protruding portion outwardly protruding therefrom to form at least one fitting groove in an internal wall of said tank, said fitting groove being adapted for receiving said peripheral edge of said flow control member, wherein said fitting groove is defined between a pair of side wall portions which are parallel to each other, said protruding portion having an insertion hole penetrating therethrough, said projection of said flow control member being inserted into said insertion hole.

2. A heat exchanger as claimed in claim 1, wherein said projection has a top end smaller in size than said insertion hole, said projection being tapered so that the thickness and the width of said projection are reduced from a base portion to the top end.

3. A heat exchanger comprising tube for passing a heat transfer medium therethrough;

tank connected to said tube; and at least one flow control member arranged within said tank to control the flow of said medium, said flow control member having a projection protruding from a peripheral edge;

said tank having a protruding portion outwardly protruding therefrom to form at least one fitting groove in an internal wall of said tank, said fitting groove being adapted for receiving said peripheral edge of said flow control member, wherein said fitting groove is defined between a pair of side wall portions which are parallel to each other, said protruding portion having an insertion hole penetrating therethrough, said projection of said flow control member being inserted into said insertion hole, said projection having a top end smaller in size than said insertion hole, said projection being tapered so that the thickness and the width of said projection are reduced from a base portion to the top end, said projection and said insertion hole being coupled to each other.

4. A heat exchanger as claimed in claim 1 or 3, wherein said flow control member is formed by a flat plate material.

5. A heat exchanger as claimed in claim 1 or 3, wherein a plurality of flow control members are arranged at a predetermined space to divide an internal space of said tank in a longitudinal direction, at least one of said flow control members being provided with a flow through portion for regulating the flow of said medium so as to mix a liquid phase and a gas phase of said medium.

6. A heat exchanger as claimed in claim 1 or 3, wherein said peripheral edge of said flow control member is fitted into said fitting groove.

7. A heat exchanger as claimed in claim 2 or 3, wherein said projection has a pair of first tapered portions formed so that the thickness of said projection is reduced towards the top end, and a pair of second tapered portions formed so that the width of said projection is reduced towards the top end.

* * * * *

UNITED STATES PATENT AND TRADEMARK OFFICE

CERTIFICATE OF CORRECTION

PATENT NO. : 5,894,886

DATED : April 20, 1999

INVENTOR(S) : Tomohiro CHIBA et al.

It is certified that error appears in the above-identified patent and that said Letters Patent is hereby corrected as shown below:

On the title page:

Item --[76] Inventors: Tomohiro Chiba; Shigeru Okada, both of Isesaki-Shi, Gunma, Japan--;

In the claims:

Claim 3, line 2, before "tube" insert --a--; and
line 3, before "tank" insert --a--.

Signed and Sealed this

Fourteenth Day of March, 2000

*Attest:*

*Attesting Officer*

Q. TODD DICKINSON

*Commissioner of Patents and Trademarks*

UNITED STATES PATENT AND TRADEMARK OFFICE

CERTIFICATE OF CORRECTION

PATENT NO. : 5,894,886

DATED : April 20, 1999

INVENTOR(S) : Tomohiro CHIBA et al.

It is certified that error appears in the above-identified patent and that said Letters Patent is hereby corrected as shown below:

On the title page: insert
Item –[73] Assignee: Sanden Corporation, Gunma, Japan–;

Signed and Sealed this

Fifteenth Day of August, 2000

*Attest:*

*Attesting Officer*

Q. TODD DICKINSON

*Director of Patents and Trademarks*